US010172435B2

(12) United States Patent
Pires et al.

(10) Patent No.: US 10,172,435 B2
(45) Date of Patent: Jan. 8, 2019

(54) COSMETIC APPLICATOR

(71) Applicant: Zen Design Solutions Limited, Ot (HK)

(72) Inventors: Leo Clifford Pires, Basking Ridge, NJ (US); Rahul Bose, New Delhi (IN); Iti Seth, Faridabad (IN); Smita Srivastava, New Delhi (IN); Rajesh Deswal, Rohtak (IN)

(73) Assignee: ZEN DESIGN SOLUTIONS LIMITED, Kowloon (HK)

( * ) Notice: Subject to any disclaimer, the term of this patent is extended or adjusted under 35 U.S.C. 154(b) by 367 days.

(21) Appl. No.: 15/071,929

(22) Filed: Mar. 16, 2016

(65) Prior Publication Data

US 2016/0270514 A1 Sep. 22, 2016

(30) Foreign Application Priority Data

Mar. 20, 2015 (IN) ..... 771/DEL/2015

(51) Int. Cl.
*A45D 40/26* (2006.01)

(52) U.S. Cl.
CPC ..... *A45D 40/265* (2013.01)

(58) Field of Classification Search
CPC ..... A45D 40/00; A45D 40/26; A45D 40/261; A45D 40/262; A45D 40/265; A45D 40/28; A45D 2040/0012; A46B 7/02; A46B 7/023; A46B 7/026; A46B 9/021; A46B 9/08; A46B 9/10; A46B 2200/1046; A46B 2200/1053; A46B 2200/106
See application file for complete search history.

(56) References Cited

U.S. PATENT DOCUMENTS 1,626,992 A * 5/1927 Willk ..... A45D 33/36 401/116
3,529,899 A * 9/1970 Gruska ..... A45D 34/042 401/121
5,121,763 A * 6/1992 Kingsford ..... A45D 40/28 132/317
5,345,644 A * 9/1994 Gueret ..... A46B 3/18 132/218
6,331,085 B1 12/2001 Schrepf et al.
6,688,317 B2 * 2/2004 Gueret ..... A45D 40/26 132/320
7,481,591 B2 1/2009 Dumler
(Continued)

*Primary Examiner* — Rachel R Steitz
(74) *Attorney, Agent, or Firm* — Patterson + Sheridan, LLP

(57) ABSTRACT

A cosmetic applicator for applying a cosmetic or care product includes an applicator head assembly comprising a first application surface and a second application surface. The first application surface is a continuous application surface whereas the second application surface is a discontinuous application surface. The second application surface is a collection of a plurality of application surfaces, wherein each of the application surfaces has an area smaller than an area of the continuous application surface. The applicator head assembly comprises a hollow sleeve and an insertion member which is configured to be received and retained within the hollow sleeve. The insertion member includes a plurality of elongated projections which defines the second application surface whereas the first application surface is defined on a portion of the hollow sleeve.

17 Claims, 7 Drawing Sheets

(56) References Cited

U.S. PATENT DOCUMENTS

| | | | | |
|---|---|---|---|---|
| 2007/0183834 | A1* | 8/2007 | Beak | A45D 34/045<br>401/121 |
| 2007/0227553 | A1* | 10/2007 | Gueret | A45D 34/04<br>132/320 |
| 2010/0310298 | A1* | 12/2010 | Tsai | A45D 33/36<br>401/143 |
| 2013/0104925 | A1* | 5/2013 | Caulier | A45D 40/262<br>132/218 |

* cited by examiner

COSMETIC APPLICATOR

CROSS-REFERENCE TO RELATED APPLICATION

This application claims benefit of Indian Provisional Application Ser. No. 771/DEL/2015, filed Mar. 20, 2015, which is incorporated by reference in its entirety.

BACKGROUND

Field of the Invention

Embodiments of the present disclosure generally relate to an applicator for applying a product including a cosmetic or a care product. More particularly, the present disclosure relates to an applicator which provides sensorial experience such as the applicator massages skin of a user in an application area. The cosmetic or care product includes viscous cosmetics, powder cosmetics, mascara, eye liner, lip gloss, hair color, wound care, skin care, under eye cosmetics, pharmaceutical and like products.

Description of the Related Art

Applicators such as dip or wand applicators are known in the cosmetic industry. Cosmetic packages often include such applicators for dispensing a particular cosmetic contained in the package reservoir. The cosmetic applicator generally includes a wand/stem with a cap at one end and an applicator head in the form of a brush, spatula or other applicator structure suitable for applying a cosmetic or a care product including viscous cosmetics, mascara, eye liner, lip gloss, hair color, wound care, skin care, under eye cosmetics, pharmaceutical and like products.

One such applicator is disclosed in U.S. Pat. No. 6,331,085 B1 for applying and transporting a quantity of cosmetic product to a user's skin. The applicator comprises a generally cylindrical elastomeric tip with a long axis, the tip including a distal end portion having a distal extremity with at least one material-holding concavity formed therein, and said concavity having a rim.

Another U.S. Pat. No. 7,481,591 discloses an applicator comprising a rod and an application surface formed of a plurality of cones. These cones have a certain elasticity and movability and can therefore massage the cosmetic product, which is stored between them into wrinkles and uneven areas of the skin of a user.

While such applicators are generally satisfactory, there still exists a need for an applicator for applying a product to user's skin that additionally serves to massage the skin of a user.

SUMMARY

According to an embodiment of the present disclosure there is provided an applicator for applying a product including a cosmetic or a care product. More particularly, the present disclosure relates to an applicator which massages skin of a user in an application area. The cosmetic or care product includes viscous cosmetics, mascara, eye liner, lip gloss, hair color, wound care, skin care, under eye cosmetics, pharmaceutical and like products. Nom According to an embodiment of the present disclosure, there is provided an applicator comprising an applicator head assembly retained at a distal end of a stem for applying the product; and a cap at a proximal end of the stem.

According to another embodiment of the present disclosure, there is provided a packaging device comprising a receptacle for holding the product and the applicator as described above. The cap of the applicator has threads which can be screwed onto corresponding threads formed on a neck of the receptacle.

According to another embodiment of the present disclosure, a wiper unit is inserted in a neck of the receptacle for wiping off excess product from the applicator. The wiper unit comprises an annular bead for engaging into a corresponding annular groove on the inside of the neck of the receptacle. Alternately, other engagement means like threads, snap, j-lock may be used to fit the wiper unit in the neck of the receptacle.

The proximal end of the stem of the applicator is attached to the cap and distal end of the stem includes an interior longitudinal cavity for receiving and retaining the applicator head assembly.

According to an embodiment of the present disclosure, the applicator head assembly comprises a first application surface and a second application surface. According to another embodiment of the present disclosure, the first application surface is a continuous application surface whereas the second application surface is a discontinuous application surface. The first application surface comprises a single application surface and the second application surface is a collection of a plurality of application surfaces. Each of the plurality of application surfaces of the second application surface has an area smaller than an area of the first application surface.

According to an embodiment of the present disclosure, the applicator head assembly comprises a hollow sleeve and an insertion member which is configured to be received and retained within the hollow sleeve. The hollow sleeve is substantially cylindrical or frustoconical in shape, and has an open proximal end and an open distal end. A distal end of the hollow sleeve defines an upper edge or rim which is oriented at a substantially oblique angle to a longitudinal axis of the applicator head assembly. More particularly, the upper edge or rim has a spatulate form i.e. the upper edge or rim has a broad rounded apex and a narrow base. In alternate embodiments, the rim may have any other suitable shape such as ovate, obovate, elliptic, oblong, deltoid etc. The outer surface of a sidewall of the hollow sleeve and the upper edge or rim of the hollow sleeve define the first application surface. A proximal end portion of the hollow sleeve is formed as shank which is configured to be received within the cavity of the stem. According to an embodiment of the present disclosure, diameter of the shank is less than diameter of the distal end portion of the hollow sleeve.

According to another embodiment of the disclosure, the insertion member has an elongated length, more particularly, the insertion member is an elongated rod like structure having a proximal end and a distal end. A distal end portion of the insertion member includes an upper surface and a plurality of elongated projections. According to an embodiment, the upper surface is oriented in a plane which is oblique with respect to the longitudinal axis of the applicator head assembly. Each of the plurality of elongated projections may be a filament like structure.

According to an embodiment, at least one of the plurality of elongated projections includes a tip defined at a distal end of the elongated projection. The tip of the elongated projection defines a second application surface.

According to an embodiment, greatest transverse section of the tip of the elongated projection is greater than greatest transverse section of the rest of the elongated projection. Alternately, the tip defines greatest transverse dimension of the elongated projection. The tip of the elongated projection can be of a shape selected from spherical, globular, elliptical, arcuate, flat, oval or any other shape, such that greatest transverse section of the tip is greater than greatest transverse section of rest of the elongated projection.

According to an embodiment, the elongated projections are resilient in nature and are capable of moving independent of each other when subjected to the external stimulus such as pressure, temperature, electricity, magnetism, light, radio frequency, micro-wave or radiation.

According to another embodiment, the plurality of elongated projections includes at least one central projection and at least one lateral projection. The at least one central projection runs on a midline of the upper surface and subsequently extends out from the upper surface along the oblique plane of the upper surface. The at least one lateral projection projects laterally from the central projection or in alternate embodiments the at least one lateral projection projects laterally from the upper surface or from the midline of the upper surface.

During assembling of the applicator head assembly, as the insertion member is inserted into the hollow sleeve, the at least one lateral projection moves or gets closer towards the central projection, and stands upright in the longitudinal direction of the applicator, such that at least one of the tips of the elongated projections lies above the distal end or upper edge or rim of the hollow sleeve. According to an embodiment, at least one of the tips of the elongated projections lies on at least a portion of the upper edge or rim of the hollow sleeve. Thus, the second application surface projects above the first application surface. The tips of the elongated projections define the second application surface to spread the product on user's skin. Further, during application of the product to the user's skin, the tips move individually to produce light tapping, providing a gentle multi-point massage to the user's skin.

According to an embodiment of the present disclosure, the plurality of elongated projections creates a compound application surface and wherein the density of the compound application surface is altered during the assembly of the applicator head. The altered density of the plurality of elongated projections can be deemed to be increased upon such assembly.

The insertion member can be retained within the hollow sleeve, by locking means known in art such as a j-lock, a threaded engagement, an interference engagement, magnetic engagement or the like. In an exemplary embodiment, the hollow sleeve and the insertion member are secured to each other by snap-fitment. The hollow sleeve includes an annular projection on its inner surface and the insertion member includes an annular recess and an annular flange below said annular recess. When the applicator head assembly is assembled, the proximal end of the insertion member is inserted into the hollow sleeve through the distal end of the hollow sleeve, the annular projection of the hollow sleeve snap fit into the corresponding annular recess of the insertion member, and thus limiting further downward movement of the insertion member with respect to the hollow sleeve. The insertion member is longer than the hollow sleeve and the recess of the insertion member is provided at such a length of the insertion member that upon locking of insertion member within the hollow sleeve, the proximal end of the insertion member extends out from the proximal end of the molded sleeve. Further, an upward movement of the insertion member is restricted by the flange of the insertion member which locks against the annular projection.

In an alternate embodiment, the annular projection may be on the insertion member, in such a case, the annular recess is on the hollow sleeve.

According to an embodiment of the present disclosure, there are provided complimentary orientation features on the inner surface of the hollow sleeve and outer surface of the insertion member to orient the insertion member with respect to the hollow sleeve in a desired direction. Preferably, the insertion member is so oriented that the central projection is always in line with a distal end of the hollow sleeve. The inner surface of the hollow sleeve has an orientation feature in form of a longitudinal groove. Similarly, a complimentary orientation feature which is a protruded part is provided on the outer surface of the distal end portion of the insertion member and wherein the protruded part extends along the longitudinal axis on the distal end portion of the insertion member. When the insertion member is inserted into the hollow sleeve, the protruded part fits into the longitudinal groove so as to align the central projection in a longitudinal direction of the applicator and in line with the distal end of the hollow sleeve.

The applicator head assembly and the stem may be fit together by friction fit, snap fit, magnetic attraction, by gluing, crimping and the like. In an exemplary embodiment, the applicator head assembly and the stem are fitted together by snap fitment. The shank portion includes at least one annular bead and the inner surface of the rod includes corresponding annular recess. When the proximal end portion/shank of the applicator head assembly is inserted into the interior longitudinal cavity of the stem, the at least one annular bead is snap-fitted in corresponding annular recess.

According to another embodiment of the present disclosure, the insertion member of applicator head assembly may comprise an internal product delivery passage which extends from the proximal end to the distal end of the insertion member, and thus transforming the applicator head into a flow through applicator. The flow through applicator head assembly is attachable to a neck of a container for example, a tube container. The hollow sleeve of the applicator head assembly further comprises suitable engagement means for engaging with a neck of a container such as an interference engagement, snap fitment, a j-lock, a threaded engagement, magnetic engagement or the like. The insertion member is provided with a product delivery orifice on its upper surface. The internal product delivery passage in the insertion member provides fluid communication between the container and the orifice to permit the product to flow or be expelled from the container through the orifice to the upper surface of the insertion member. The product expelled through the orifice is then applied using the tips/upper ends of elongated projections present on the upper surface of the insertion member, the tips thus constituting a discontinuous application surface i.e. second application surface. The expelled product can be further spread or applied using a rim and/or outer surface of a sidewall of the hollow sleeve.

According to an alternate embodiment of the present disclosure, the outer surface of the sleeve and the upper edge/rim of the hollow sleeve defining the first application surface; and the elongated projections defining the second application surface are covered by a flock coating.

According to an alternate embodiment of the present disclosure, at least one of the first application surface and the second application surface is covered by a flock coating.

According to an embodiment of the present disclosure, at least a tip of one elongated projection is covered by a flock coating.

According to an embodiment of the present disclosure, only the rim of the hollow sleeve is covered by a flock coating.

According to an embodiment of the present disclosure, material used for making the applicator head assembly can be selected from a group consisting of plastic, metal, alloy, ceramic, stone, wood, rubber and the like.

According to an embodiment of the present disclosure, the hollow sleeve is fabricated from a material selected from a group consisting of plastic, metal, alloy, ceramic, stone, wood, rubber and the like.

According to an embodiment of the present disclosure, the insertion member is fabricated from a material selected from a group consisting of plastic, metal, alloy, ceramic, stone, wood, rubber and the like.

Although the present disclosure has been described herein with reference to particular embodiments, it is to be understood that these embodiments are merely illustrative of certain principles and applications of the present disclosure. It is further to be understood that numerous modifications may be made to the illustrative embodiments and that other arrangements may be devised without departing from the present disclosure.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings.

Figure 1:
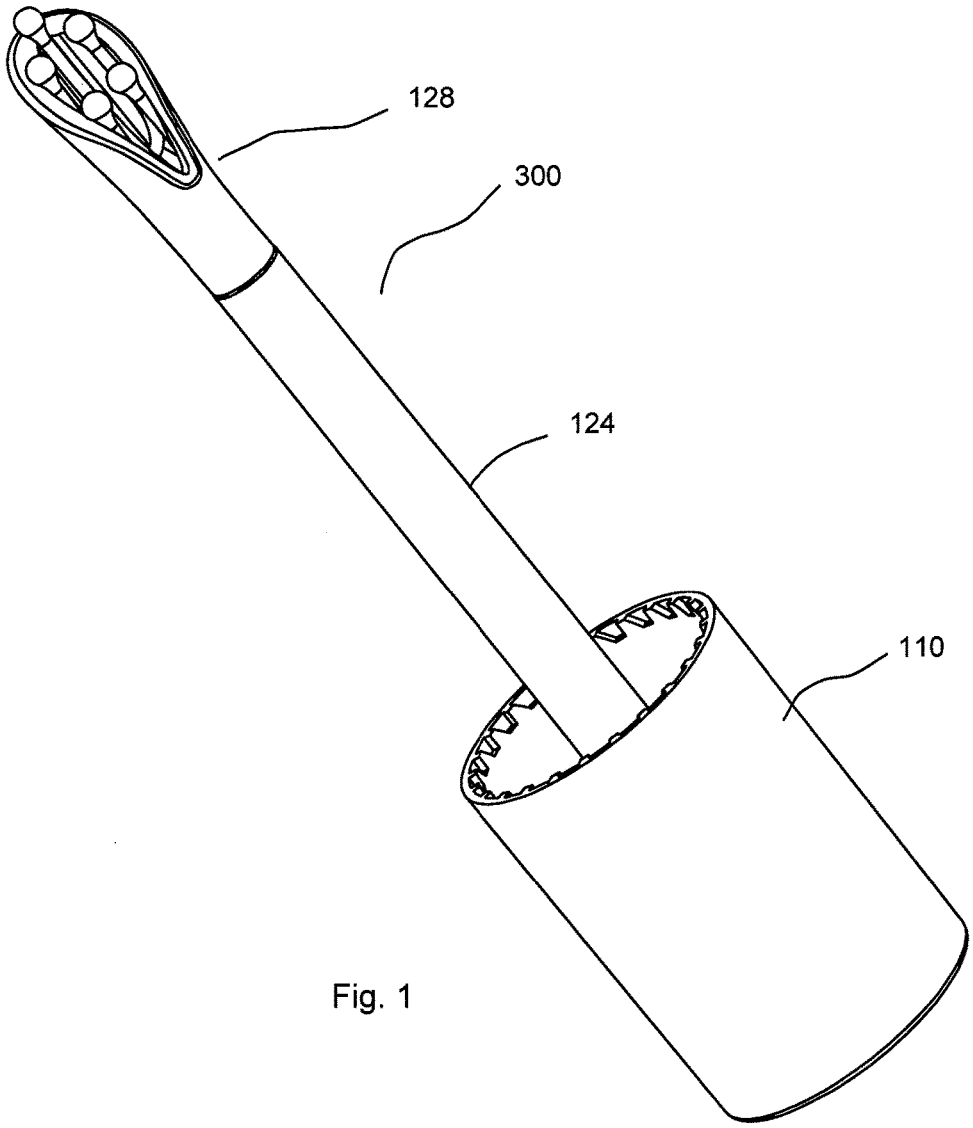
FIG. 1 shows a perspective view of an applicator of FIG. 1.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

Throughout this specification, the terms "comprise," "comprises," "comprising" and the like, shall consistently mean that a collection of objects is not limited to those objects specifically recited.

Figure 2:
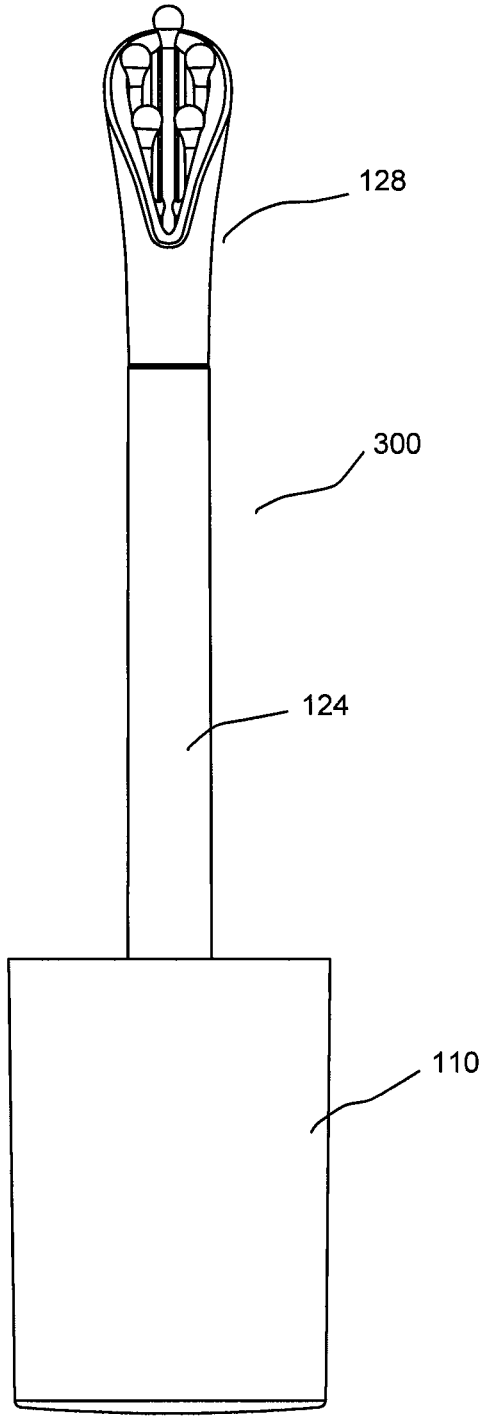
FIG. 2 shows a front view of the applicator of FIG. 1.
Figure 3:
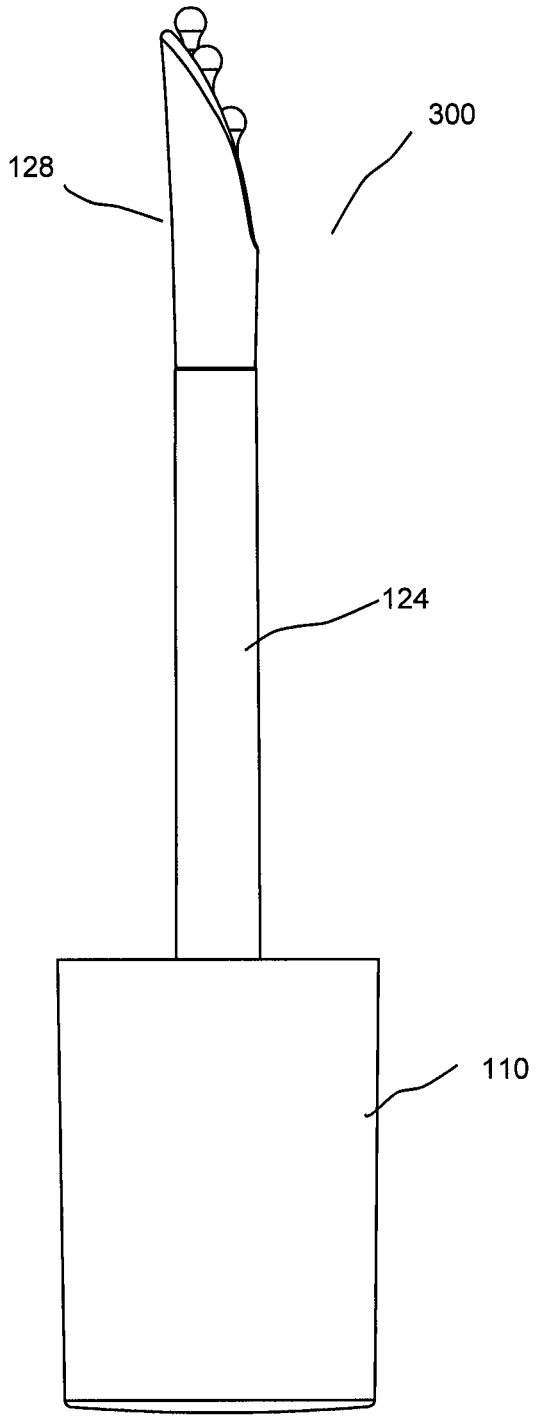
FIG. 3 shows a side view of the applicator of FIG. 1.

FIG. 1, FIG. 2 and FIG. 3 illustrate an isometric view, a front view and a side view respectively of an applicator 300 according to one embodiment of the disclosure. The applicator 300 may be used to apply a product (not shown) including a cosmetic or care product. The cosmetic or care product includes viscous cosmetics, mascara, eye liner, lip gloss, hair color, wound care, skin care, under eye cosmetics, pharmaceutical and like products.

As shown in FIGS. 1-3, the applicator 300 comprises an applicator head assembly 128 retained at a distal end of a stem 124 for applying the product; and a cap 110 at a proximal end of the stem 124.

Figure 4:
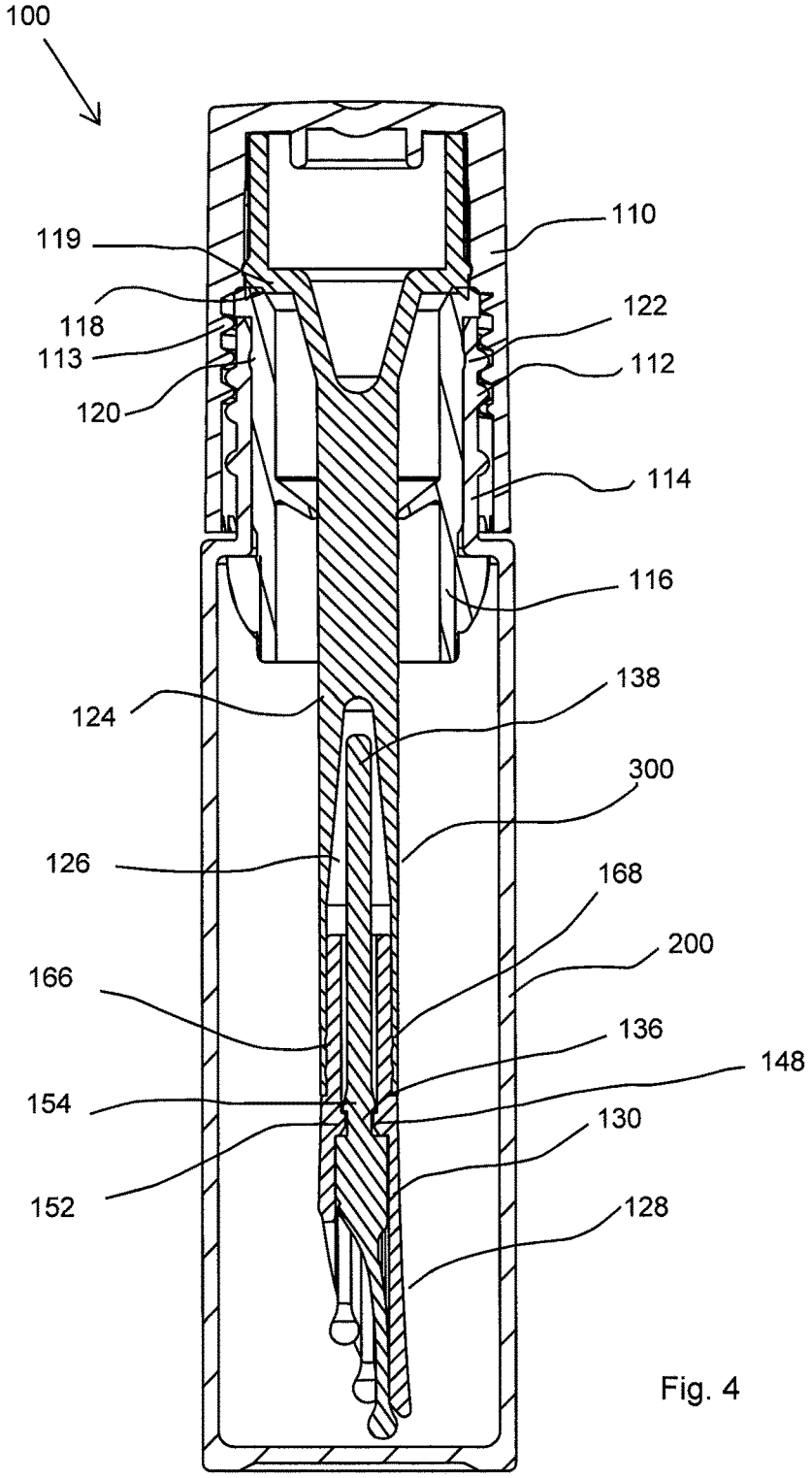
FIG. 4 shows a longitudinal sectional view of a packaging device provided with the applicator of FIG. 1.

FIG. 4 illustrates a longitudinal sectional view of a packaging device 100. The packaging device 100 comprises a receptacle 200 for holding the product (not shown) and the applicator 300. The cap 110 of the applicator 300 has threads 113 which can be screwed onto threads 112, formed on a neck 114 of the receptacle 200.

Inserted in the neck 114 of the receptacle 200 is a wiper unit 116 for wiping off excess product from the applicator 300. The wiper unit 116 also comprises an annular bead 120 for engaging into a corresponding annular groove 122 on the inside of the neck 114 of the receptacle 200. Alternately, the wiper unit 116 may be attached to the neck 114 by other attachment means selected from a group consisting of adhesive, threads, j-lock and the like.

The proximal end of the stem 124 of the applicator 300 is attached to the cap 110 and its distal end includes an interior longitudinal cavity 126 for receiving and retaining the applicator head assembly 128.

Figure 5A:
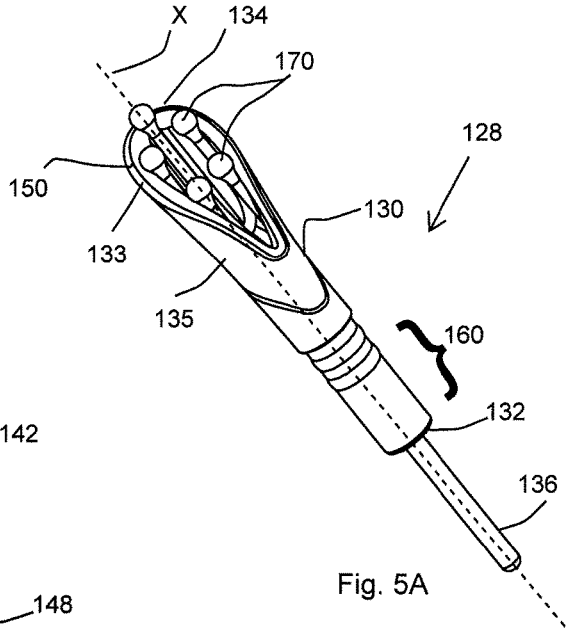
FIG. 5A shows a perspective view of the applicator head assembly of the applicator of FIG. 1.
Figure 5B:
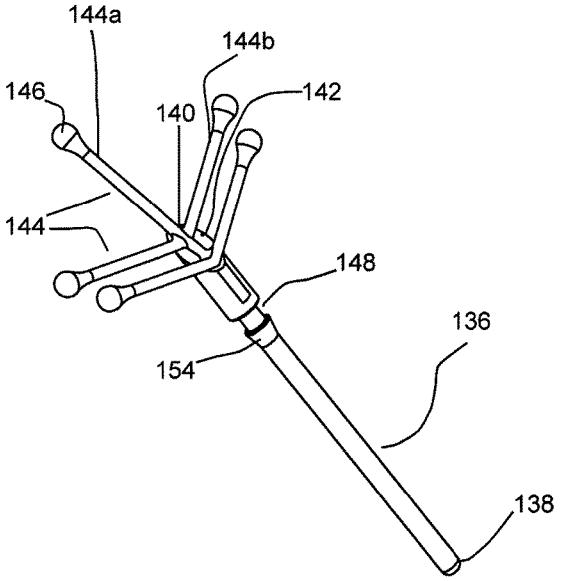
FIG. 5B shows an exploded view of the applicator head assembly of FIG. 5A.
Figure 5B:
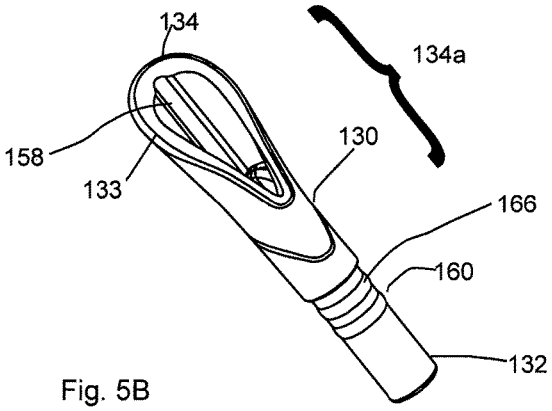
Figure 5C:
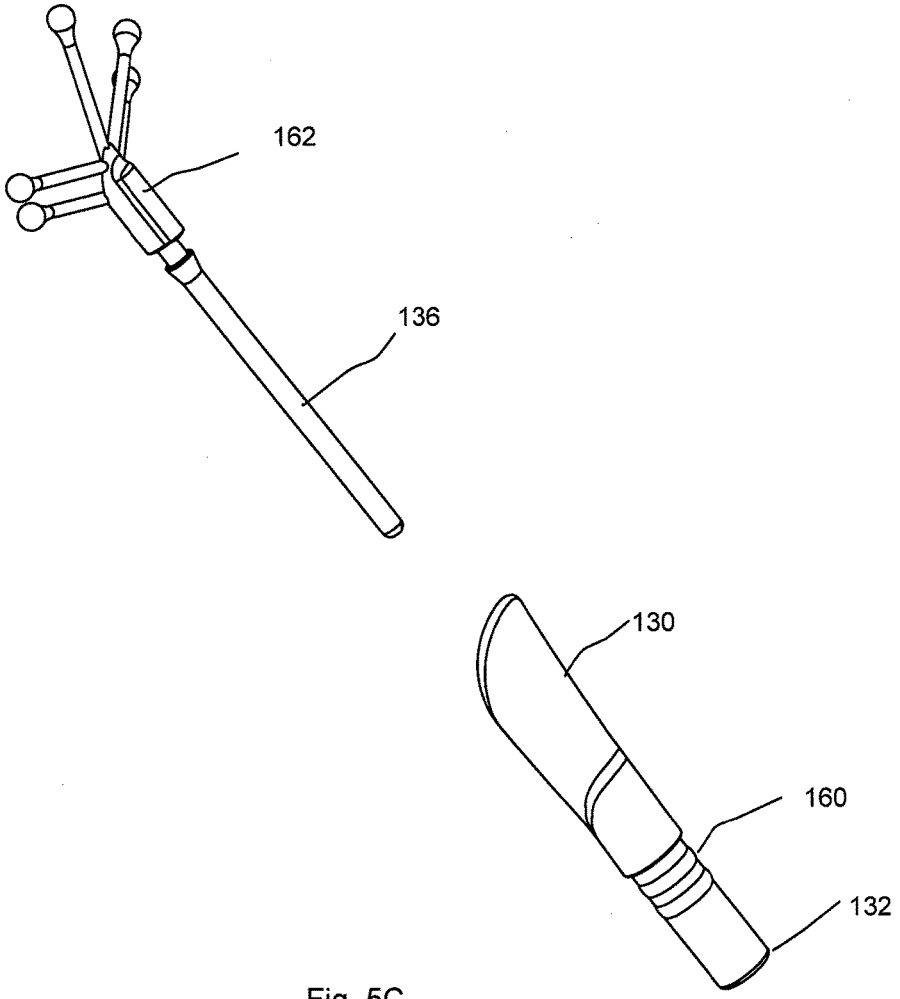
FIG. 5C shows another exploded view of the applicator head assembly of FIG. 5A to show some features not shown in FIG. 5B.

FIGS. 5A and 5B show a perspective and an exploded view of the applicator head assembly 128 respectively.

As shown in FIGS. 1 to 5B, the applicator head assembly 128 comprises a first application surface 150 and a second application surface 170. According to an embodiment, the first application surface 150 is a continuous application surface whereas the second application surface 170 is a discontinuous application surface.

Further, as shown in FIG. 5A and FIG. 5B, the applicator head assembly 128 comprises a hollow sleeve 130 and an insertion member 136 which is configured to be received and retained within the hollow sleeve 130. The hollow sleeve 130 is substantially cylindrical in shape, and has an open proximal end 132 and an open distal end 134. A distal end of the hollow sleeve 130 defines an upper edge/rim 133 which is oriented at a substantially oblique angle with respect to a longitudinal axis X of the applicator head assembly 128. More particularly, the upper edge/rim 133 has a spatulate form i.e. the upper edge/rim 133 has a broad rounded apex and a narrow base. In alternate embodiments, the rim 133 may have any other suitable shape such as ovate, obovate, elliptic, oblong, deltoid etc. The first application surface 150 is defined by outer surface of the rim 133 and outer surface of a sidewall 135 of the hollow sleeve 130. A proximal end portion of the hollow sleeve 130 is formed as shank 160 which is configured to be received within the cavity 126 of the stem 124. According to an embodiment of the present disclosure, diameter of the shank 160 is less than diameter of the distal end portion of the hollow sleeve 130.

Further, the insertion member 136 is an elongated rod like structure having a proximal end 138 and a distal end 140. A distal end portion of the insertion member 136 includes an upper surface 142, and a plurality of elongated projections 144 projecting from the upper surface 142. According to an embodiment, the upper surface 142 is oriented in a plane which is oblique with respect to the longitudinal axis X of the applicator head assembly 128. Each of the plurality of elongated projections 144 is a filament like structure. According to an embodiment, at least one of the plurality of elongated projections 144 has a tip 146 defined at least at a distal end of the elongated projection 144. The tip 146 of the elongated projection 144 defines a second application surface 170.

According to an embodiment, greatest transverse section of the tip 146 of the elongated projection 144 is greater than greatest transverse section of the rest of the elongated projection 144. Alternately, the tip 146 defines greatest transverse dimension of the elongated projection 144. The tip 146 of the elongated projection 144 can be of a shape selected from spherical, globular, elliptical, arcuate, oval, flat or any other shape, such that greatest transverse section of the tip 146 is greater than greatest transverse section of rest of the elongated projection 144.

According to an embodiment, the elongated projections 144 are resilient in nature and are capable of moving independent of each other on application of an external stimulus such as pressure, temperature, electricity, magnetism, light, radio frequency, micro-wave or radiation.

According to another embodiment, the plurality of elongated projections 144 projecting from the upper surface 142 includes at least one central projection 144*a* and at least one lateral projection 144*b*. The at least one central projection 144*a* runs on the midline of the upper surface 142 and subsequently extends out from the upper surface 142 along the oblique plane of the upper surface 142. The at least one lateral projection 144*b* projects laterally from the central projection 144*a* or in an alternate embodiment, the at least one lateral projection 144*b* may project laterally from the upper surface 142 or from the midline of the upper surface 142.

During assembling of the applicator head assembly 128, as the insertion member 136 is inserted into the hollow sleeve 130, the at least one lateral projection 144*b* gets closer/towards the central projection 144*a*, and stand upright in longitudinal direction of the applicator head assembly 128, such that at least one of the tips 146 of the elongated projections 144 lies above the upper edge/rim 133 or distal end 134 of the hollow sleeve 130. According to an embodiment, at least one of the tips 146 of the elongated projections 144 lies on at least a portion of the upper edge/rim 133 of the hollow sleeve 130. The tips 146 of the elongated projections 144 define the second application surface 170 to spread the product on user's skin. Further, during application of the product to the user's skin, the tips 146 move individually to produce light tapping, providing a gentle multi-point massage to the user's skin.

The insertion member 136 can be retained within the molded hollow sleeve 130, by locking means known in art such as a j-lock, a threaded engagement, an interference engagement, magnetic engagement or the like. In an exemplary embodiment as shown in FIG. 4, the hollow sleeve 130 and the insertion member 136 are secured to each other by snap-fitment. The snap-fitment will now be explained by referring to FIGS. 4 through 5B. The hollow sleeve 130 includes an annular projection 152 on its inner surface and the insertion member 136 includes an annular recess 148 and an annular flange 154 below said annular recess 148. When the applicator head assembly 128 is assembled, the proximal end 138 of the insertion member 136 is inserted into the hollow sleeve 130 through the distal end 134 of the hollow sleeve 130, the annular projection 152 of the hollow sleeve 130 snap fit into the corresponding annular recess 148 of the insertion member 136, and thus limiting further downward movement of the insertion member 136 with respect to the hollow sleeve 130. The insertion member 136 is longer than hollow sleeve 130 and wherein the recess 148 of the insertion member 136 is provided at such a length of the insertion member 136 that upon locking of insertion member 136 within the hollow sleeve 30, the proximal end 138 of the insertion member 136 extends out from the proximal end 132 of the molded sleeve 130. Further, an upward movement of the insertion member 136 is restricted by the flange 154 of the insertion member 136 which locks against the annular projection 152.

In an alternate embodiment, the annular projection 152 may be on the insertion member 136 in which case, the annular recess 148 is on the hollow sleeve 130.

According to an embodiment of the present disclosure, there are provided complimentary orientation features on the inner surface of the hollow sleeve 130 and outer surface of the insertion member 136 to orient the insertion member 136 with respect to the hollow sleeve 130 in a desired direction. Preferably, the insertion member 136 is so oriented that the central projection 144*a* is always in line with a distal end 134 of the hollow sleeve 130. As shown in the FIGS. 5B and 5C, an orientation feature which is a longitudinal groove 158 is provided on the inner surface of the molded hollow sleeve 130. Similarly, a complimentary orientation feature which is a protruded part 162 is provided on the outer surface of the distal end portion of the insertion member 136 and wherein the protruded part 162 extends along the longitudinal axis on the distal end portion of the insertion member 136. When the insertion member 136 is inserted into the hollow sleeve 130 the protruded part 162 fits into the longitudinal groove 158 so as to align the central projection 144*a* in longitudinal direction and in line with the distal end 134 of the hollow sleeve 130.

The applicator head assembly 128 and the rod 124 may be fit together by friction fit, snap fit, by gluing, crimping, magnetic engagement and the like. In an exemplary embodiment as shown in FIG. 4, the applicator head assembly 128 and the stem 124 are fitted together by snap fitment. The shank portion 160 includes at least one annular bead 166 and the inner surface of the stem 124 includes corresponding annular recess 168. When the proximal end portion/shank 160 of the applicator head assembly 128 is inserted into the interior longitudinal cavity 126 of the rod 124, the at least one annular bead 166 is snap-fitted in corresponding annular recess 168.

According to an alternate embodiment of the present disclosure, the outer surface of the hollow sleeve 130 and the upper edge/rim 133 defining the first application surface 150; and the elongated projections 144 defining the second application surface 170 are covered by a flock coating.

According to an alternate embodiment of the present disclosure, at least one of the first application surface 150 and the second application surface 170 is covered by a flock coating.

Figure 6:
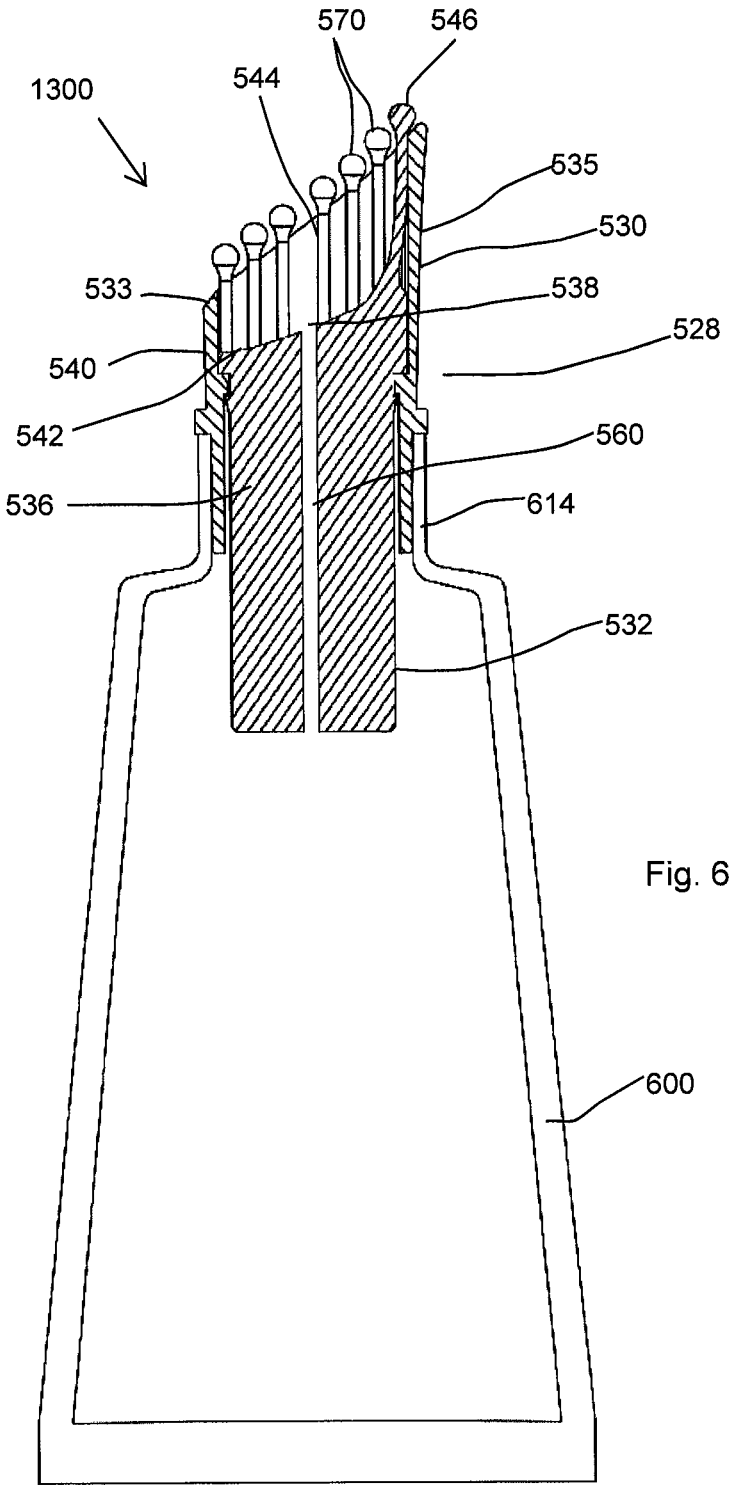
FIG. 6 shows a longitudinal sectional view of a packaging device provided with an applicator head assembly according to a second embodiment of the present disclosure.

FIG. 6 shows a longitudinal sectional view of a packaging assembly 1300 provided with an applicator head assembly 528 according to a second embodiment of the present disclosure. The packaging device 1300 comprises a receptacle 600 for holding the product (not shown) and the applicator head assembly 528 securely mounted in a neck 614 of the receptacle 600. The applicator head assembly 528 has suitable engagement means for engaging to the neck 614 of the receptacle 600 such as an interference engagement, snap fitment, a j-lock, a threaded engagement, magnetic engagement or the like. The applicator head assembly 528 resembles the applicator head assembly 128 except in that the insertion member is provided with a delivery passage and a flange is provided in the hollow sleeve. In the embodiment shown, a product delivery orifice 538 is provided on an upper surface 542 of the insertion member 536. The internal product delivery passage 560 in the insertion member 536 provides fluid communication between the receptacle 600 and the orifice 538 to permit the product to flow or be expelled from the receptacle 600 through the orifice 538 to the upper surface of the insertion member 536. The product expelled through the orifice 538 then may be applied using the tips/upper ends 546 of elongated projections 544 present on the upper surface 542 of the insertion member 536, the tips thus constituting a discontinuous application surface i.e. second application surface. The expelled product can be further spread or applied using a rim 533 and/or outer surface of a sidewall 535 of the hollow sleeve 530.

According to an embodiment of the present disclosure, at least tip 146, 546 of one elongated projection 144, 544 is covered by a flock coating.

According to an embodiment of the present disclosure, only the rim 133, 533 of the hollow sleeve 130, 530 is covered by a flock coating.

According to an embodiment of the present disclosure, material used for making the applicator head assembly 128, 528 can be selected from a group consisting of plastic, metal, alloy, ceramic, stone, wood, rubber and the like.

According to an embodiment of the present disclosure, the hollow sleeve 130, 530 is fabricated from a material selected from a group consisting of plastic, metal, alloy, ceramic, stone, wood, rubber, sintered or porous material and/or combinations thereof.

According to an embodiment of the present disclosure, the insertion member 136, 536 is fabricated from a material selected from a group consisting of plastic, metal, alloy, ceramic, stone, wood, rubber, sintered or porous material and/or combinations thereof.

Although the present disclosure has been described herein with reference to particular embodiments, it is to be understood that these embodiments are merely illustrative of certain principles and applications of the present disclosure. It is further to be understood that numerous modifications may be made to the illustrative embodiments and that other arrangements may be devised without departing from the present disclosure.

What is claimed is:

1. A cosmetic applicator for applying a cosmetic or care product, the cosmetic applicator comprising:

a stem having a proximal end and a distal end;

an applicator head assembly received and retained in a cavity at the distal end of the stem;

a cap retained at the proximal end of the stem;

wherein the cap is removably attachable on a neck of a receptacle;

wherein the applicator head assembly comprises a hollow sleeve and an insertion member configured to be received and retained in the hollow sleeve;

wherein the insertion member includes a solid elongated rod, the insertion member includes an upper surface defined at a distal end of the solid elongated rod and a plurality of elongated projections extending from the upper surface;

wherein the plurality of elongated projections are resilient and are capable of moving independent of one other; and wherein a tip of at least one of the plurality of elongated projections lies above a distal end of the hollow sleeve; and the distal end of the hollow sleeve is oriented at an oblique angle to a longitudinal axis of the applicator head assembly.

2. The cosmetic applicator according to claim 1, wherein the upper surface is oriented in a plane oblique to a longitudinal axis of the applicator head assembly.

3. The cosmetic applicator according to claim 1, wherein the hollow sleeve is cylindrical or frusto-conical in shape.

4. The cosmetic applicator according to claim 1, wherein the plurality of elongated projections includes at least one central projection and at least one lateral projection.

5. The cosmetic applicator according to claim 4, wherein the at least one central projection extends on a midline of the upper surface and subsequently extends out from the upper surface along an oblique plane of the upper surface.

6. The cosmetic applicator according to claim 4, wherein the at least one lateral projection projects laterally from a midline of the upper surface.

7. The cosmetic applicator according to claim 4, wherein when the insertion member is inserted into the hollow sleeve, the at least one lateral projection gets closer to the at least one central projection, and stands upright in a longitudinal direction of the cosmetic applicator.

8. The cosmetic applicator according to claim 4, wherein the at least one central projection of the insertion member is aligned with the distal end of the hollow sleeve.

9. The cosmetic applicator according to claim 1, wherein the plurality of elongated projections of the insertion member creates a compound application surface and wherein density of the compound application surface is altered when the insertion member is inserted inside the hollow sleeve.

10. The cosmetic applicator according to claim 1, wherein the insertion member is longer than the hollow sleeve.

11. The cosmetic applicator according to claim 1, wherein at least a portion of an outer surface of the hollow sleeve defines a first application surface and tips of the plurality of elongated projections define a second application surface.

12. The cosmetic applicator according to claim 1, wherein the hollow sleeve is fabricated from a material selected from a group consisting of plastic, metal, alloy, ceramic, stone, wood, and rubber.

13. The cosmetic applicator according to claim 1, wherein the plurality of elongated projections are fabricated from a material selected from a group consisting of plastic, metal, alloy, ceramic, stone, wood, and rubber.

14. The cosmetic applicator according to claim 1, wherein the hollow sleeve has orientation features on its inner surface and complimentary orientation features are provided on an outer surface of the insertion member to orient the insertion member with respect to the hollow sleeve.

15. A cosmetic applicator for applying a cosmetic or care product, the cosmetic applicator comprising:

an applicator head assembly;

wherein the applicator head assembly comprises a hollow sleeve and an insertion member configured to be received and retained in the hollow sleeve;

wherein at least a portion of an outer surface of the hollow sleeve defines a first application surface;

wherein the insertion member includes an elongated rod, the insertion member has an upper surface defined at a distal end of the elongated rod and a plurality of elongated projections extending from the upper surface;

wherein tips of the plurality of elongated projections define a second application surface;

wherein an area of each of the tips of the plurality of elongated projections is smaller than an area of the first application surface;

wherein the upper surface of the insertion member lies below a distal end of the hollow sleeve and within the hollow sleeve;

wherein the elongated rod of the insertion member of the applicator head assembly comprises an internal product delivery passage extending from a proximal end to the upper surface of the insertion member; and wherein the applicator head assembly is retained on a neck of a receptacle.

16. A cosmetic applicator for applying a cosmetic or care product, the cosmetic applicator comprising:

a stem having a proximal end and a distal end;

an applicator head assembly received and retained in a cavity at the distal end of the stem;

a cap retained at the proximal end of the stem;

wherein the applicator head assembly comprises a hollow sleeve and an insertion member configured to be received and retained in the hollow sleeve; wherein a distal end of the hollow sleeve is oriented at an oblique angle to a longitudinal axis of the applicator head assembly wherein the insertion member includes solid elongated rod, the insertion member includes an upper surface defined at a distal end of the solid elongated rod and a plurality of elongated projections extending from the upper surface;

wherein at least one of the plurality of elongated projections includes a tip defined at a distal end of the at least one elongated projection; and wherein a greatest transverse section of the tip is greater than a greatest transverse section of the rest of the at least one elongated projection.

17. The cosmetic applicator according to claim 16, wherein shape of the tip of at least one of the plurality of elongated projections is selected from a group consisting of spherical, globular, elliptical, arcuate, oval, and flat.

* * * * *